US007131239B2

(12) United States Patent
Williams

(10) Patent No.: US 7,131,239 B2
(45) Date of Patent: Nov. 7, 2006

(54) STRUCTURAL SLAB AND WALL ASSEMBLY FOR USE WITH EXPANSIVE SOILS

(76) Inventor: Jonathan P. Williams, 3201 Mariner La., Longmont, CO (US) 80503

( * ) Notice: Subject to any disclaimer, the term of this patent is extended or adjusted under 35 U.S.C. 154(b) by 491 days.

(21) Appl. No.: 10/172,384

(22) Filed: Jun. 13, 2002

(65) Prior Publication Data

US 2003/0188496 A1 Oct. 9, 2003

Related U.S. Application Data

(60) Provisional application No. 60/371,202, filed on Apr. 9, 2002.

(51) Int. Cl.
*E02D 27/00* (2006.01)

(52) U.S. Cl. ..... 52/169.5; 52/169.6; 52/169.14; 52/264

(58) Field of Classification Search ..... 52/323, 52/250, 294, 257, 79.14, 143, 155, 158, 169.9, 52/299, 252, 274, 335, 336; 405/230, 257, 405/256, 231; 403/508, 545
See application file for complete search history.

(56) References Cited

U.S. PATENT DOCUMENTS 1,229,364 A * 6/1917 White ..... 405/230
1,644,572 A * 10/1927 Ferry et al. ..... 405/230
3,320,704 A * 5/1967 Forsythe et al. ..... 52/127.3
3,495,371 A * 2/1970 Mitchell, Jr. ..... 52/653.1
3,562,979 A * 2/1971 Ali-Oglu ..... 52/125.5
4,285,173 A * 8/1981 Grearson et al. ..... 52/73
4,507,901 A * 4/1985 Carroll ..... 52/302.3
4,945,695 A * 8/1990 Majurinen ..... 52/252
5,050,358 A * 9/1991 Vladislavic ..... 52/334
5,259,157 A * 11/1993 Ault ..... 52/145
5,560,150 A * 10/1996 Pearson ..... 52/79.14
5,564,235 A 10/1996 Butler
5,664,378 A * 9/1997 Bettigole et al. ..... 52/414
5,729,940 A * 3/1998 Bullivant ..... 52/299
5,771,518 A * 6/1998 Roberts ..... 14/73.1
5,782,049 A 7/1998 Gates et al.
5,797,226 A * 8/1998 MacKarvich ..... 52/155
5,931,604 A * 8/1999 Queen et al. ..... 405/232
5,934,036 A 8/1999 Gallagher, Jr.
6,131,350 A 10/2000 Sanders
6,237,291 B1 5/2001 Elwart
6,289,638 B1 9/2001 Vasseur
6,295,784 B1 * 10/2001 Richard ..... 52/741.15
6,314,693 B1 11/2001 Sanders
6,379,085 B1 * 4/2002 Vanderklaauw ..... 405/230
7,003,918 B1 * 2/2006 Williams ..... 52/169.5
2002/0078646 A1 * 6/2002 Eaton

* cited by examiner

*Primary Examiner*—Daniel P. Stodola
*Assistant Examiner*—Nahid Amiri
(74) *Attorney, Agent, or Firm*—Kent A. Lembke; Hogan & Hartson

(57) ABSTRACT

A foundation assembly for use with expansive soils. The assembly includes a slab form, such as metal pan, for receiving poured concrete, a structural slab cast into the form, and structural members, e.g., piers, footing pads, and the like, contacting and/or extending into the soil. An elongate support member, e.g., a rectangular concrete beam, is positioned on an upper support surface of the structural members so as to contact a lower surface of the slab form. In this manner, the support member supports the slab form and structural slab and defines a void space between the soil and the slab form without the use of biodegradable materials.

13 Claims, 8 Drawing Sheets

STRUCTURAL SLAB AND WALL ASSEMBLY FOR USE WITH EXPANSIVE SOILS

CROSS REFERENCE TO RELATED APPLICATIONS

This application claims the benefit of U.S. Provisional Application No. 60/371,202, filed Apr. 9, 2002, which is incorporated by reference herein in its entirety.

BACKGROUND OF THE INVENTION

1. Field of the Invention

The present invention relates, in general, to the construction of concrete walls, slabs, and other static structures, and, more particularly, to a concrete flooring assembly, and method of fabrication, for use with expansive soils that utilizes concrete support beams to create voids and to support the structural slab.

2. Relevant Background

Commercial and residential buildings are often built on foundations comprising vertical perimeter walls of poured concrete. Since the vertical foundation walls are structural members which support the building, they are usually several feet in depth and function as beams bridging between footers or piers resting on bedrock or stable soil. It is common practice in such buildings to provide a basement, or ground floor, wherein at least a portion of the basement walls include the vertical foundation walls and wherein the basement floor is a poured concrete slab resting on the soil enclosed by the foundation walls. Typically, the foundation is constructed by first excavating a pit for the basement and for the foundation footers. Then, forms are erected around the periphery of the pit and concrete for the foundation walls is poured into the forms.

A major problem with conventional construction in certain soil and climate conditions is that the location of the basement floor can be unstable due to movement of the underlying soil. Expansive soils are prevalent in many areas of the Unites States and other countries. These expansive soils can expand and contract considerably as a result of cyclical changes in moisture content and/or as a result of freezing and thawing cycles. The soil expansion and contraction problem can be especially severe when the floor is simply a slab of concrete poured onto the surface of the soil that forms the floor of the excavation pit. For example, certain dense clay soils tend to dry out after excavation and then later absorb water and swell. This swelling or expansion causes the slab to move relative to the foundation walls which can generate large forces that are sufficient to crack or break the slab. In general, because the foundation walls must support the building, they are supported by piers or pads on solid ground or bedrock or piers or pads on footings and therefore are very stable. However, when the basement floor is a relatively thin slab of concrete having a large surface area and resting on a large area of soil, it is highly vulnerable to movement due to expansion and contraction of the soil as water is absorbed and released by the soil. The relative motion between the slab and the walls can damage interior walls.

A variety of techniques have been implemented to control the effects of expansive soils on concrete foundations and structural slabs or floors. Generally, each of these techniques attempts to separate the foundation walls and structural slabs or flooring from the heaving soils or to at least absorb some of the expansive forces created by the moving soil. Unfortunately, these techniques have proven to be costly, to increase the complexity of fabricating concrete foundations and flooring, to cause long-term structural or safety problems, and to reduce spacing between the floor and ceiling.

For example, a common technique of protecting the foundation and slab from the expanding soil is to create a void space under the concrete slab. To create the void, cardboard forms or other degradable material forms are positioned under the form or pan used during pouring of the foundation walls and floor. With time, the material of the void form begins to deteriorate creating a void in which the soil can expand without moving the wall or floor. However, the degradation of the forms typically is accompanied by mold growth and the release of associated toxins, which can result in safety issues within the structure above the concrete foundation. Additionally, jobsite delays and inclement weather during initial construction can result in premature degradation of the cardboard void form and loss of the strength needed to support the curing concrete wall and floor.

Another technique has involved structurally supported wood floors to replace the concrete slab, but the wood product has tended to degrade in a similar fashion to the cardboard forms when exposed to moisture in the adjacent soil. More recently, raw steel components have been used to create voids spaces, but the expected life and reliability of the steel components is questionable in the moist environment below grade that is likely to cause rapid rusting.

There remains a need for an improved method and system for creating and protecting concrete foundation walls and structural slabs from the effects of expansive soils. Preferably, such a method and system would be relatively inexpensive to implement in the cost-sensitive construction industry and lend itself to the field conditions associated with excavating soil and forming. structures with concrete. Further, the method and system preferably would result in void spaces being created under structural slabs and allow removal of any degradable void forms after formation of the foundation wall and/or slab.

SUMMARY OF THE INVENTION

The present invention addresses the need for improved slab designs for use with expansive soils by providing a structural foundation assembly that generally utilizes a non-metallic, i.e., a concrete, support beam which is formed directly on structural piers or footing pads and used to support slab forming molds or pans or alternatively, is formed integrally with the flooring slab. More specifically, a foundation assembly is provided that includes a slab form, such as metal pan, for receiving poured concrete. The assembly includes a structural slab cast into the form and structural members, e.g., piers, footing pads, and the like, contacting and/or extending into the soil. An elongate support member, such as a rectangular concrete beam, is positioned on an upper support surface of the structural members so as to contact a lower surface of the slab form. In this manner, the support member supports the slab form and structural slab and defines a void space between the soil and the slab form without the use of degradable materials.

DETAILED DESCRIPTION OF THE PREFERRED EMBODIMENTS

Figure 1:
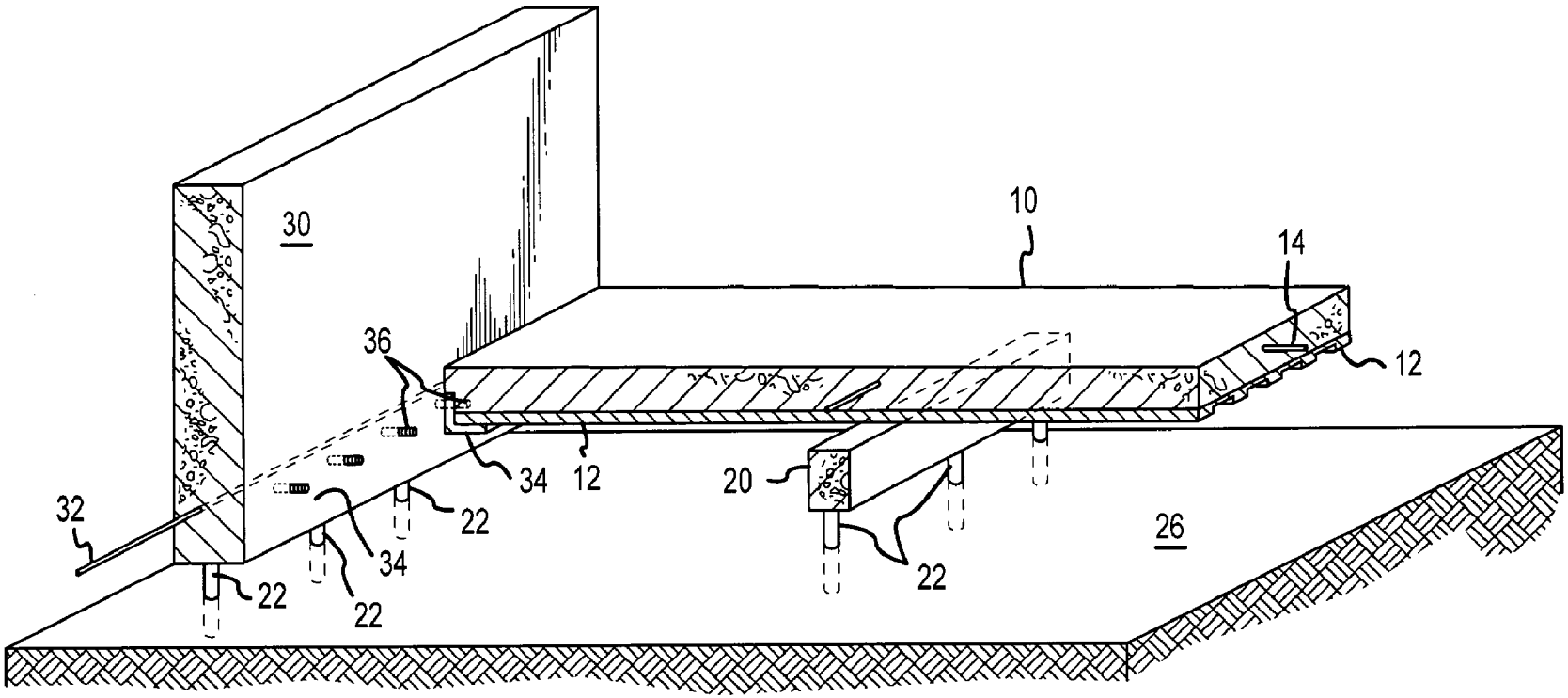
FIG. 1 is a perspective view of a structural slab and foundation wall assembly according to the present invention utilizing a concrete support beam to support a slab to create voids between the soil and the slab.

In the drawings, like reference numerals indicate like features, and a reference numeral appearing in more than one figure refers to the same element. The drawings and the following detailed descriptions show specific embodiments of the invention with numerous specific details including materials, dimensions, and products being provided to facilitate explanation and understanding of the invention. However, it will be obvious to one skilled in the art that the present invention may be practiced without these specific details and these broader embodiments of the invention are considered within the breadth of the following claims.

In general, the invention is directed to foundation wall and structural slab assemblies (and methods of fabricating such assemblies) that provide void spaces to allow the assemblies to be placed on or in expansive soil. In many of the preferred embodiments, these void spaces under the structural slabs and walls are provided without the use of cardboard, wood, and other degradable materials that may rot, mold, or deteriorate in a manner that causes undesirable off-gases or other safety problems or that may increase the complexity and cost of the wall/slab assembly or significantly reduce the expected life and/or reliability of the finished structure. These slab and/or foundation assemblies are discussed in detail with reference to FIGS. 1–5. As shown in FIG. 6, the invention also provides a slab assembly which provides concrete ribs to define an elongated penetration area in the slab in which penetrations (such as sump, electrical, or plumbing penetrations) can be made with only minimal (i.e., acceptable reductions) in the structural strength of the slab. The invention further describes a structural slab assembly that utilizes temporary (i.e., while concrete is setting or hardening) or degradable supports along with permanent concrete support beams to enable greater spans of metal pans or other concrete slab forms (see, FIG. 7). Finally, as shown in FIG. 8, the invention provides a removable form support assembly for supporting side wall forms for pouring and setting of the concrete used to form the walls and center grade beams that provide a void space without the need for degradable void boxes or materials and without reductions in effective wall heights.

One embodiment of a foundation wall and structural slab assembly of the present invention is shown in FIG. 1. As shown, a structural slab 10 is provided that is supported by a structural beam 20 above the soil or excavation floor 26 to create a void space between the slab 10 and the soil 26, which may expand and contract. Significantly, the structural beam 20 eliminates the need for degradable wood or steel beams and/or void boxes while still providing adequate structural support for the slab during initial pouring or formation activities and during the ongoing use of the slab 10. The slab 10 is typically formed using concrete that is poured into form 12, which may be a metal pan with or without channels or ribs that provide additional strength as shown in FIG. 1. For additional strength and integrity, the slab 10 may include steel bars 14, which may also be used to connect the structural slab 10 to the foundation wall 30 in conventional fashion.

The support beam 20 is also preferably formed of materials that are not readily degradable (such as cardboard void boxes) and that are not problematic in damp conditions (such as untreated steel which may rust and become weakened). In one preferred embodiment, the structural beam 20 is formed of concrete. The beam 20 may be intermittent, e.g., have gaps, or as shown may be a continuous beam that extends that length of the slab 10 (or alternatively, may be a continuous beam that extends for at least a substantial portion of the inner portion of the slab 10). The specific shape and dimensions of the beam 20 may also be varied to practice the invention. For example, in some embodiments, the beam 20 is rectangular (such as 3 by 5 inches or other useful sizes) and in other embodiments, the beam 20 is square (such as 4 by 4 inches or other useful sizes). The dimensions and shapes of the beam are preferably selected to limit the amount of materials required for the beam 20 while providing adequate support strengths for the beam 20 to support the slab 10.

Although one beam 20 is shown in FIG. 1, multiple beams 20 may be used to support the slab 10. For example, it is typically preferably (or even necessary) that the unsupported length (i.e., span distance) of pan 12 and slab 10 between the wall 30 and beam 20 and/or between adjacent beams 20 (not shown) be kept below a predetermined maximum span distance to provide desired pan 12 and slab support. This maximum span distance, of course, will vary with the shape and materials used for the pan or form 12 and the weight of the concrete used in the slab 10. In smaller slabs 10, one beam 20 located centrally between side foundation walls 30 may be adequate to support the slab 10 and pan 12 while in larger slabs 10 the use of 2 or more beams 20 with relative equal spacing may be more desirable. The number and spacing of such beams 20 may also vary based on the slab loading or weight rating desired for the slab 10.

Figure 3:
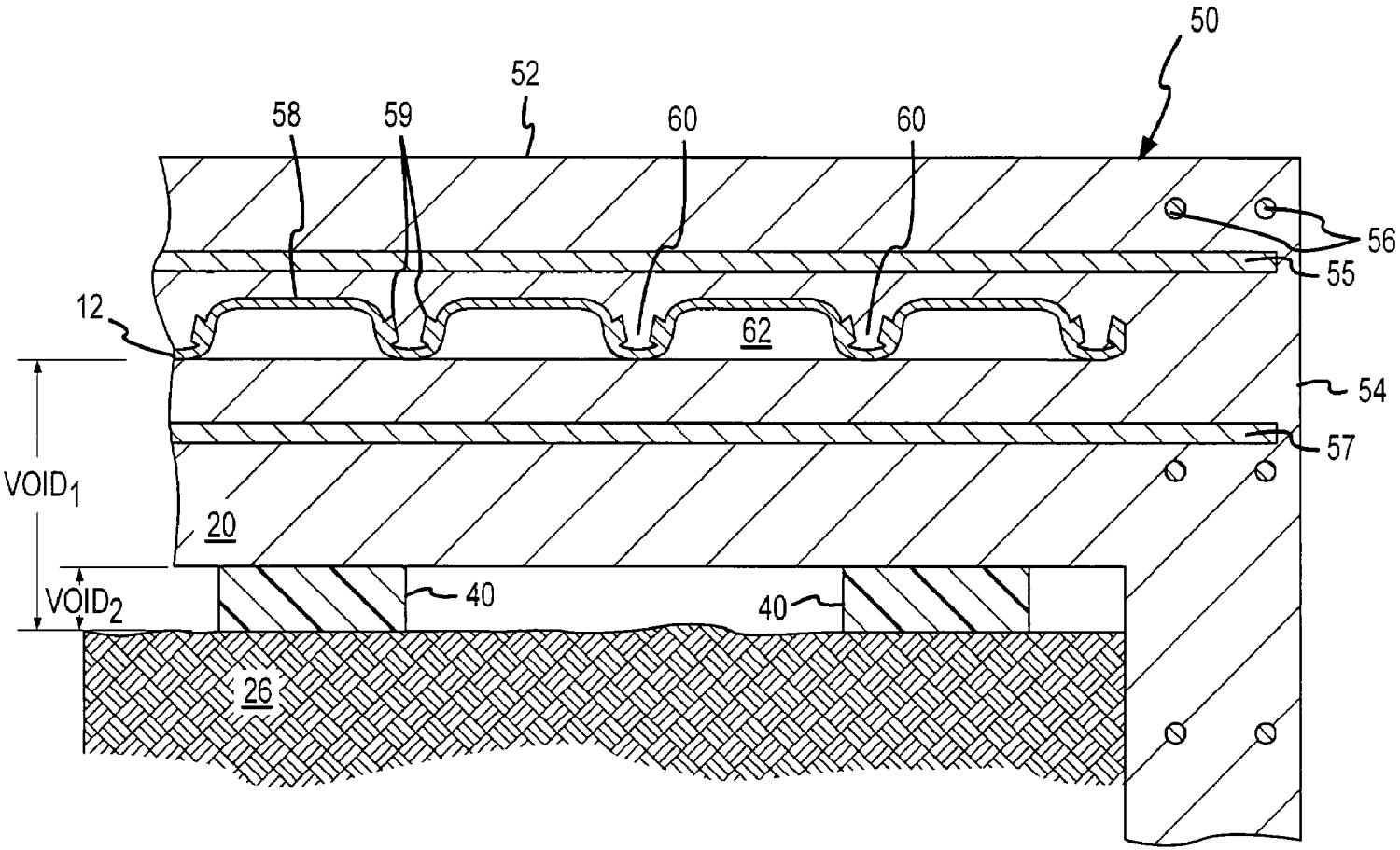
FIG. 3 is a cross-sectional view of another embodiment of a slab and foundation assembly similar to the assembly of FIG. 1 showing the use of a channeled pan and a monolithic slab and foundation wall but with a separated support beam on footing pads (rather than on piers as shown in FIGS. 1 and 2)

The support beam 20 may be positioned on piers 22 (or in some cases footing pads 40 as shown in FIG. 3 and helical screws and the like (not shown) may also be used in certain soils) that extend into the soil 26 and are typically formed from concrete. In some embodiments, the beam 20 and piers 22 are formed in a single concrete pour or in a monolithic fashion. In more typical embodiments, the piers 22 are formed prior to the placing of the beam 20 with the beams being formed upon the piers 22 (or formed elsewhere and mated to the piers 22 such as with metal beam supports formed in the piers 22 (not shown)).

Figure 2:
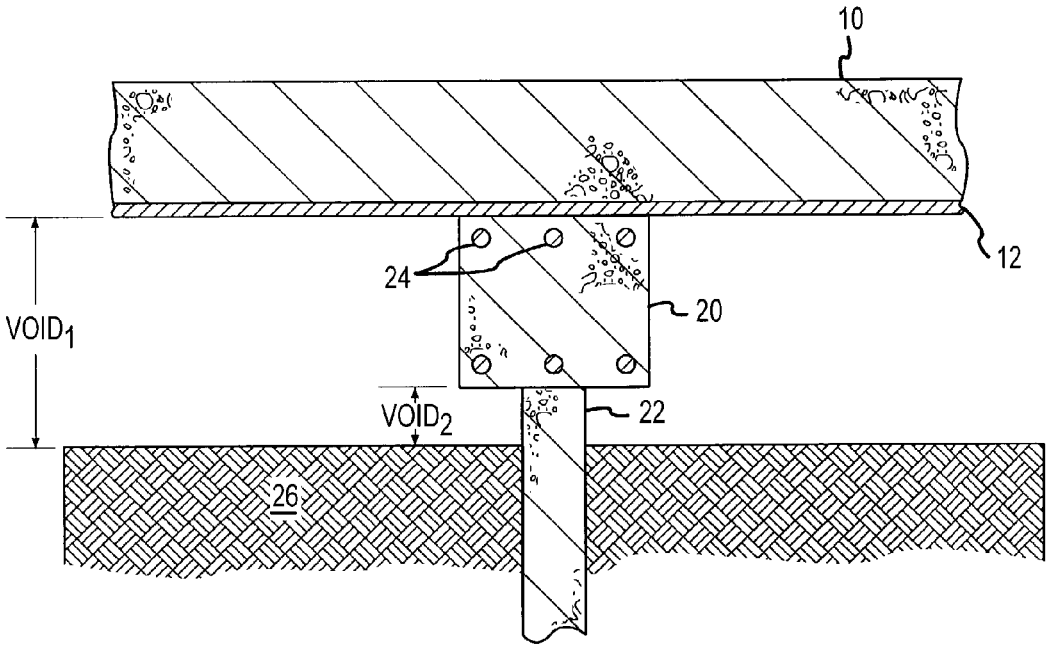
FIG. 2 is a more detailed, cross-sectional view of the slab and support beam of FIG. 1 showing the use of a pier to support the beam which, in turn, supports a form pan and the slab in the pan.

As shown in FIG. 2, the beam 20 contacts the pan or form 12 to support the slab 10 and, importantly, to provide a void or expansion space between the slab 10 and the soil 26. In the embodiment shown, a first void is provided (as shown with the arrow labeled, $Void_1$) between the slab 10 (and more specifically, between the pan 12) and the soil 26. The size of the first void or the first void distance, $Void_1$, as measured from the top of the soil 26 to the bottom of the pan 12 is initially at least as large as the side dimension of the beam 20 (accept in embodiments in which the beam 20 is placed in a trench) and is, typically, selected to be larger than anticipated expansion of the soil 26 and can vary significantly based on the composition of the soil 26 and geographically specific factors (such as moisture content in the soil 26, ground temperature variations and ranges, and the like). Although not necessary to practice the invention, the illustrated slab assembly of FIG. 2 further includes a space or void having a void distance, $Void_2$, between the bottom of the beam 20 and the soil 26. The second void is useful for initially placing the beam 22 on the piers 22 and provides added protection against the expansive soil 26. To increase the strength and structural integrity of the beam 20, steel, fiberglass, or metal bars 24 can be included with a number, size, and location well known in the construction arts.

Referring again to FIG. 1, the foundation wall and slab assembly includes a foundation wall 30 supported on piers 22 with a void space between the bottom of the wall 30 and soil or excavated floor 26. The wall 30 is not a required feature for practicing the slab assembly features of the invention. The wall 30 is typically formed onsite or in situ by pouring a hardenable material such as concrete into a form (not shown in FIG. 1 but discussed with reference to FIG. 8) and allowing the material to set and bond to the piers 22. Metal bars 32 can be provided for added strength. The wall 30 further acts to structurally support an end of the slab 10. This end support can be provided as shown with a support member 34 (such as one or more segments of angle iron or other metal or corrosion resistant material such as galvanized steel or plastic) that is attached with studs or bolts 36 drilled or otherwise attached to wall 30. The support members 34 are used to support the ends of forms 12 before and after pouring of slab 10. In this arrangement, the slab 10 and wall 30 are generally formed or poured separately. In other embodiments where the slab 10 is formed in a second pour, spaced-apart dowels are used to provide support for center grade beam 20. The dowels are formed of bent rebar (sometimes called Z-bar) and are positioned with one end extending into the wall 30 and another extending into the later poured beam 20, with the end in the beam 20 being lower than the portion in the wall 30. In yet another embodiment (shown in FIG. 3), the wall and slab are formed monolithically with poured concrete in a form or forms having connecting flow channels between the slab and wall with or without strengthening rebar extending from the slab 10 and beam 20 into the wall 30.

FIG. 3 is an end, sectional view of another foundation wall and structural slab assembly 50 similar to that shown in FIG. 1 better illustrating the forming pan 12 but utilizing a monolithic pour to form the slab 52 and the wall 54. Additionally, the assembly 50 utilizes footing pads 40 (or piers 22 as shown in FIG. 1) to support one or more support beams 20. As shown, the assembly 50 includes a foundation or side wall 54 with structural rods or bars 56 and extending vertically and extending into the soil 26 (or being spaced apart from the soil with void spaces as shown in FIG. 1) and typically supported by piers (not shown).

The sidewall 54 is bonded to (or continuously formed with) horizontally extending and planar slab 52. The slab 52 has a relatively smooth, planar upper surface but has a ribbed or channeled bottom surface for added structural strength with reduced material requirements. This is achieved using ribbed or channel forming pan 12 which has channels 58 defining air spaces or voids and, more importantly, ribs 60 that extend outward from the slab 52 and extend in a series of parallel, elongated ridges or ribs along the lower surface of the slab 52. The pan 12 further includes numerous, spaced-apart tags 59 which extend outward from sides of the channels 58 along the length of the channels 58 to protrude into the ribs 60 and "bond" the pan 12 to the slab 52 (e.g., minimize movement of the pan 12 relative to the ribs 60 especially as measured along the length of the ribs 60). A number of other form cross-sectional shapes, with or without channels 58 and/or tags 59 may be used to practice the invention and when channels 58 are provided the depth and number or density of such channels can also be varied significantly. Further, the material and pan thickness or gauge may be selected from a range of materials and material thicknesses readily available in the construction industry.

As shown in FIG. 3, the support beam 20 contacts the pan 12 to provide support for the slab 52 and to create a void between the slab 52 and the expanding soil 26. The void space is defined by a first void distance, $Void_1$, which is preferably initially (i.e., at initial installation of the assembly 50) at least as large as the side dimension of the beam 20 and is measured between the bottom of the pan 12 and the top of the soil or excavation floor 26. A second void space as defined by void distance, $Void_2$, is provided between the bottom of the beam 20 and the top surface of the soil 26. In the illustrated embodiment, the support beam 20 is spaced apart from the sidewall 54 for ease of fabrication and to structural reasons. In other embodiments not shown, the beam 20 may be structurally attached to the wall 54 or even monolithically formed with the wall 54 and the slab 52 (or just with the wall such as in embodiments similar to that shown in FIG. 1 where the wall and slab are formed as separate elements).

Figure 4:
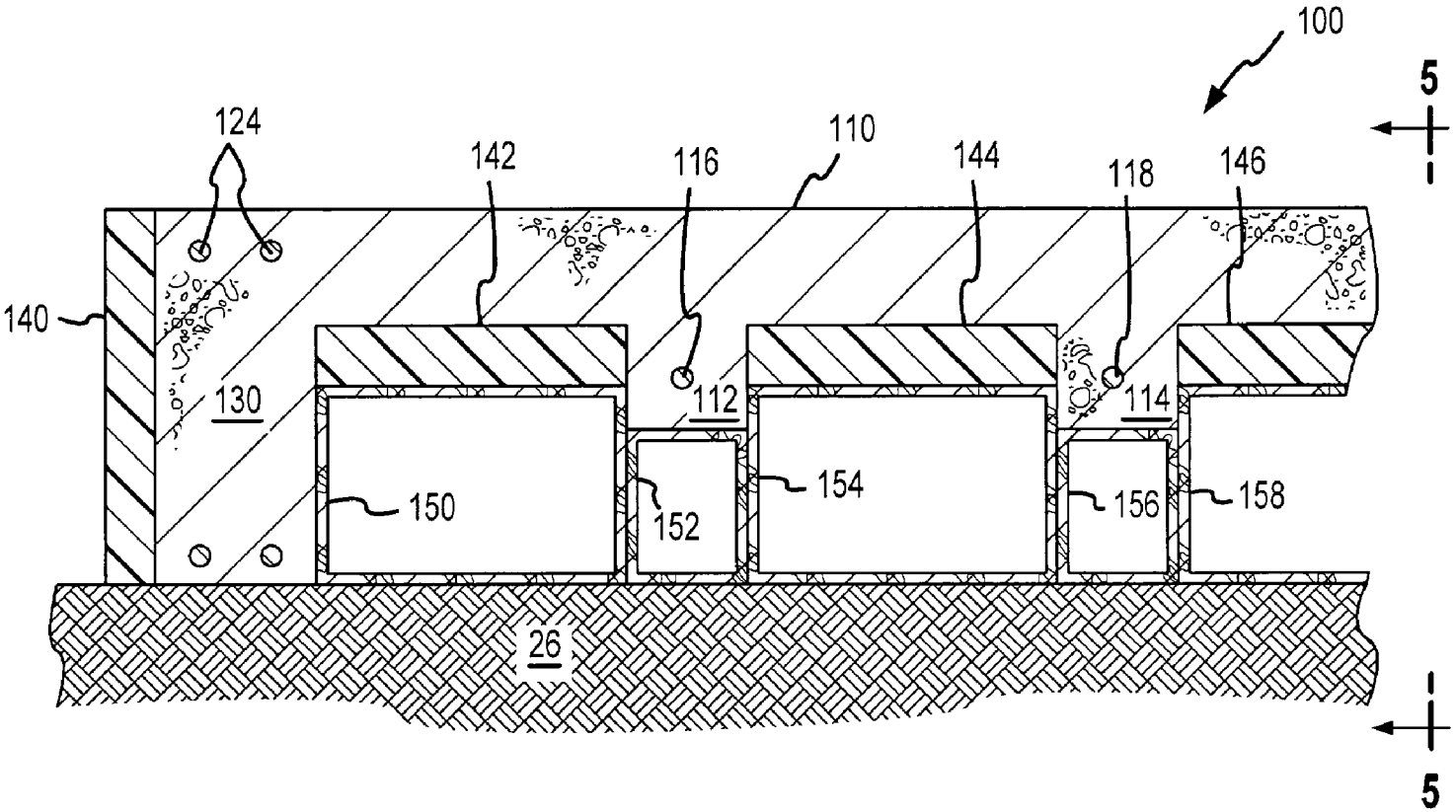
FIG. 4 is a cross-sectional view of another embodiment of a slab and foundation wall assembly of the invention illustrating a monolithic slab and foundation wall assembly with integral ribs provided in the slab for structural strength and showing the combined use of insulating forms and void forms.
Figure 5:
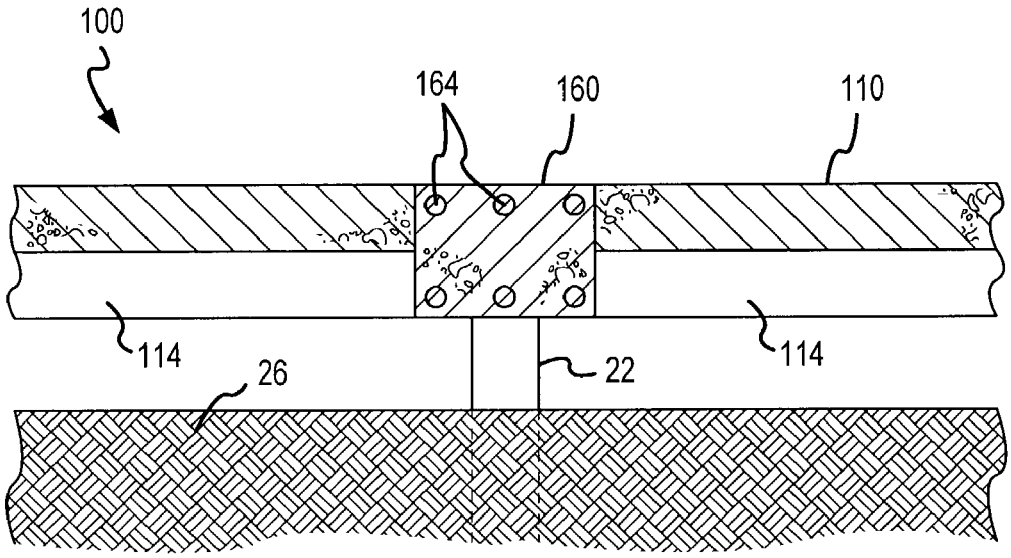
FIG. 5 is a side, cross-sectional view of the slab and foundation wall assembly of FIG. 4 with the insulating and void forms removed showing the use of a structural cross-beam formed integrally or monolithically with the slab and ribs and supported by piers.
Figure 6:
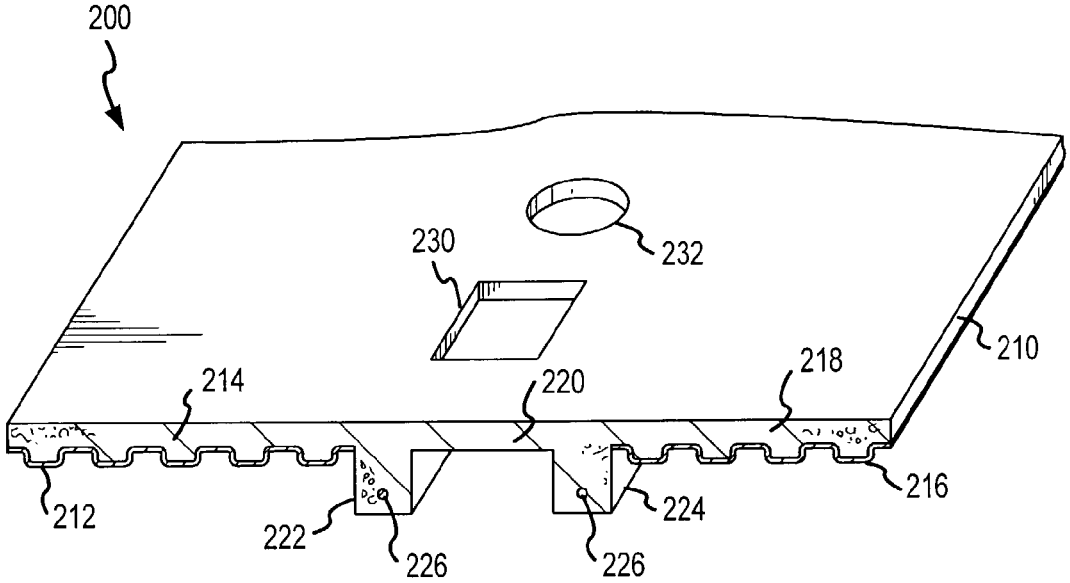
FIG. 6 shows a slab assembly fabricated with two structural ribs formed integral with the slab used to define a penetration area or surface on the slab.

FIGS. 4 and 5 illustrate a foundation wall and slab assembly 100 that uses an integrated support slab and structural ribs to facilitate a single pouring to create a monolithic wall, slab, and support beam structure or assembly 100. Additionally, although not required to practice the invention, the assembly 100 includes features that limit or reduce the amount of heat loss through the walls and slab by enhancing the thermal insulation value of these features of the assembly 100. Referring to FIG. 4, the assembly 100 includes a structural slab 100 and foundation side wall(s) 130 that can be formed from a single concrete pour. The wall 130 is shown with reinforcing bars 124 and may be positioned in contact with soil 26 or, as is the case in many embodiments, be supported on piers (such as piers 22 shown in FIG. 1) with a void space provided between soil 26 and wall 130. For structural integrity and strength, the slab 110 includes ribs 112, 114 with reinforcing bars 116, 118 (with one bar 116, 118 shown for simplicity but with the understanding that plurality of metal or other material bars typically would be included). The ribs 112, 114 extend across the bottom of the slab 110 to provide increased strength as compared to a slab without ribs 112, 114 and are spaced apart a distance (such as a rib separation distance) selected based on the thickness and composition of the slab 110 and based on the desired carrying capacity or rating of the assembly 100.

FIG. 5 illustrates the assembly 100 showing only the features of the slab 110. As shown, a structural support beam 160 with reinforcing bars 164 is centrally positioned within the slab 110. The structural beam 160 is formed of concrete or other hardenable material and is typically formed concurrently with the slab 110 in a single pour. The support beam 160 is connected (such as by single pouring with or without structural bar connections) to the ribs 112, 114 and is substantially perpendicular to these ribs 112, 114 but may be oblique or at any useful angle to the ribs 112, 114. The support beam 160 is shown rectangular but may also have a square cross sectional shape. The beam 160 is illustrated to have an upper surface that coincides with the upper surface of the slab 110 and to have a lower surface that coincides with the lower surface of the ribs 114 (and 112). In other embodiments, the lower surface and/or the upper surface of the beam 160 is not level with these other surfaces (e.g., may extend beyond or even be recessed from these surfaces). The beam 160 typically extends to mate with the sidewall 130 (and opposing side wall not shown) but may be spaced apart as shown in FIG. 3. The support beam 160 is formed on support piers 22 to provide a void space between the soil 26 and the slab 110 and more particularly, between the soil and the support beam 160 and the ribs 112, 114 to account for expansions and contractions of soil 26. Only one integral support beam 160 is shown, but in larger slabs 110 or for slabs where additional loading capacity is desired, additional beams 160 may be provided (e.g., equidistally positioned across the slab 110).

To provide increased thermal insulation and to facilitate mono pouring the wall 30 and slab 110, the assembly 100 is formed using a combination of insulating forms or inserts and degradable void supports (or boxes). As shown in FIG. 4, insulating inserts 140, 142, 144, 146 are positioned adjacent the side wall 130 and between the reinforcing ribs 112, 114. The insulating inserts 140, 142, 144, 146 may be fabricated from a number of insulating materials with high insulation properties and with adequate strength to support poured concrete until the concrete has set or hardened. For example, but not as a limitation, the insulating inserts 140, 142, 144, 146 can be made of a foamed polymer, such as expanded polystyrene (EPS), which lends itself to sizing and positioning at building sites. The particular material used for and the thickness (such as 2 to 6 inches or more) of the inserts 140, 142, 144, 146 can vary to suit the building location and the intended use of the structure incorporating the assembly 100 (for example, larger thicknesses of more thermally insulative materials may be used in colder regions or regions with larger temperature ranges).

The insulating inserts 140, 142, 144, 146 are supported during pouring by soil 26 for insert 140 and by void supports 150, 154, and 158. Void supports 152, 156 are provided to create a lower forming surface for reinforcing ribs 112, 114 (and in some embodiments, an insulating insert may be provided below the ribs 112, 114 as discussed above). The void supports 150, 152, 154, 156, 158 define the void spaces between the slab 110 and ribs 112, 114 and are constructed of a material that provided temporary support during fabrication of the assembly 100 but which then disintegrates over time and/or that then deforms under pressure created by movement or expansion of the soil 26. For example, the void supports 150, 152, 154, 156, 158 can be made of a degradable material which disintegrates or degrades when exposed to moisture, such as corrugated paper, cardboard, or other fibrous material, biodegradable plastic, and the like that are well-known in the construction industry.

In many cases, penetrations are desirable in structural flooring slabs for utilities (such as plumbing, electrical, and the like) and other functions. FIG. 6 illustrates a structural slab assembly 200 that includes a penetration section 220 in which penetrations (such as penetrations 230, 232) can be provided with minimal reduction in the overall strength of the slab assembly 200. As shown, the slab assembly 220 includes a slab 210, e.g., a concrete slab, is formed with first and second ribbed sections 214, 218. The ribbed sections 214, 218 are formed utilizing pans 212, 216 (which may be pans similar to pans 12 of FIG. 1) that create protruding ribs that extend along the length of the sections 214, 218.

Importantly, a penetration section 220 is formed in the slab 210 between the two ribbed sections 214, 218. The penetration section 220 is configured to retain structural integrity (or with only limited or acceptable reduction in strength) even with penetrations formed in the section 220, such as penetrations 230, 232. The penetration section 220 generally has the thickness of about the adjacent ribbed sections 214, 218 and further, includes spaced-apart reinforcing ribs 222, 224 with bars 226 that define the edges of the penetration section 220 and provide increased structural strength for the penetration area 220 as compared to ribbed sections 214, 218. The dimensions and shape of the reinforcing ribs 222, 224 may vary to practice the invention. For example, in the illustrated embodiment, the ribs 222, 224 are rectangular in shape and extend beyond the ribs of sections 214, 218. In other embodiments, the ribs 222, 224 may be more square in shape or have sloped sides that angle inward from the base adjacent the sections 214, 218 to the tip of the ribs 222, 224. The width of the penetration section 220 (particularly, the width between the ribs 222, 224) may be selected from a relatively large range and again will depend upon a number of design factors such as composition of the concrete, the thickness of the slab 210 and section 220, the shape and dimensions of the ribs 222, 224, the desired strength or load capacity of the slab assembly 200, and the size and shape of the penetrations 230, 232.

To facilitate fabrication of the slab assembly 200, the ribs 222, 224 may serve as structural support beams, such as beam 20 of FIG. 1, and be supported on piers 22. Alternatively or in combination, a support beam, such as beam 20 of FIG. 1, may be run transverse or substantially perpendicularly to the reinforcing ribs 222, 224, e.g., be centrally positioned on the slab 210 and be integral with the ribs 222, 224 and supported on piers 22 (with or without pier support being provided for ribs 222, 224). Void supports or boxes (not shown) of degradable material can be used to support the pans 212, 216 during pouring and setting of the sections 214, 218. Additionally, void boxes or forms may be used to define the shape of the ribs 222, 224. Optionally, insulating inserts may be provided between the ribs 222, 224 and/or adjacent the pans 212, 216. The slab 200 may be joined to foundation walls as shown in FIGS. 1, 3, or 4.

Figure 7:
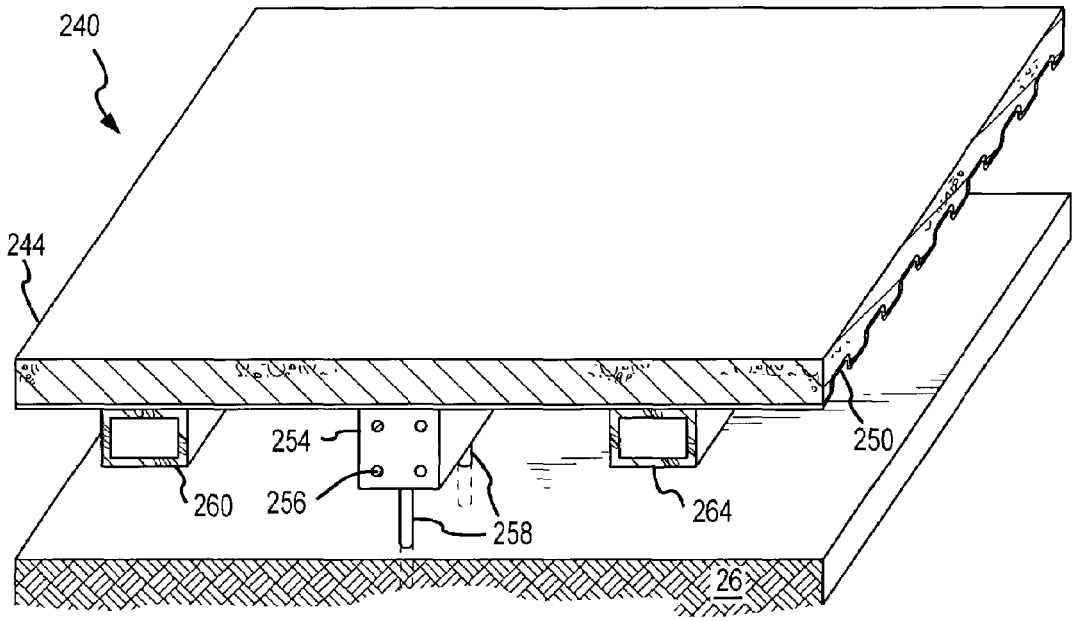
FIG. 7 illustrates another structural slab assembly showing the use of temporary or degradable void boxes along with a permanent, concrete support beam to provide greater extensions with metal form pans.
Figure 8:
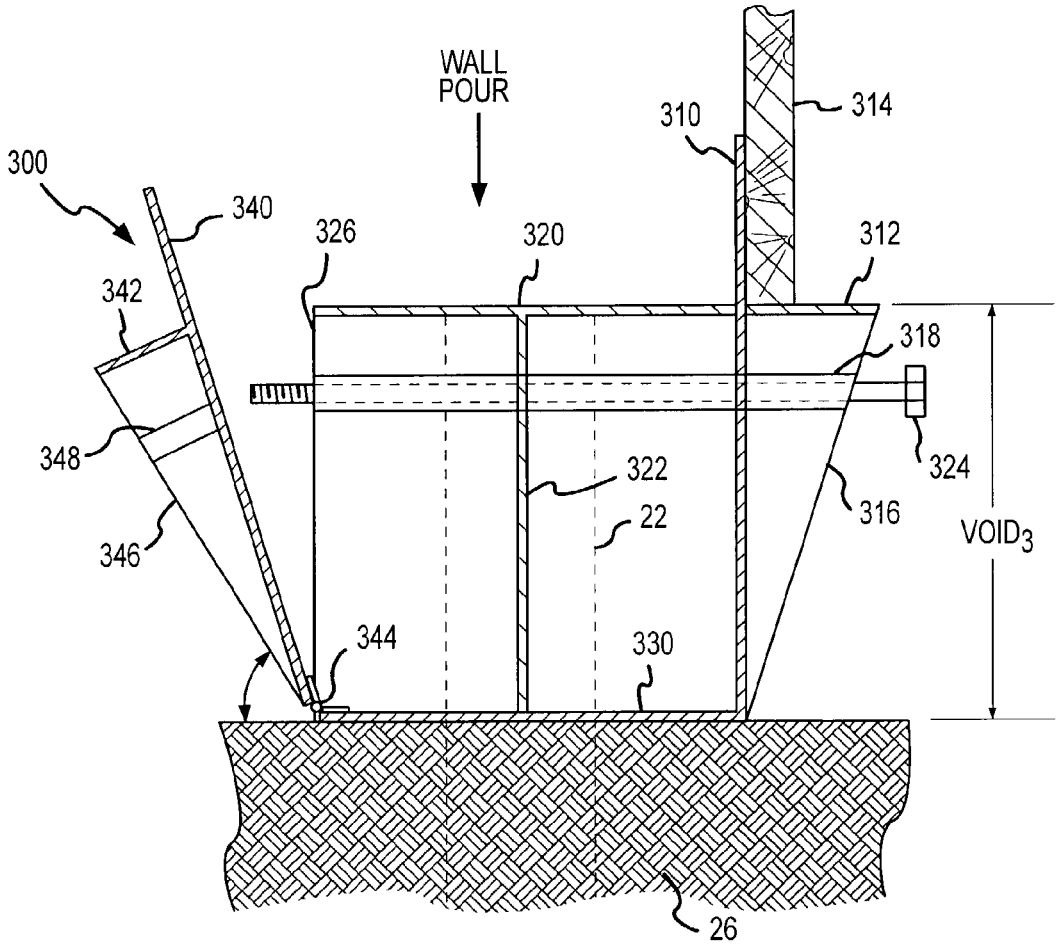
FIG. 8 is a sectional, side view of a removable wall form support that is useful for supporting wall panels and grade beam forms over structural piers to create a void under the wall without the need for degradable void boxes.

FIG. 7 illustrates another embodiment of a structural slab assembly 240 that can be used in the place of the slab 10, 52, or 110 to facilitate greater spans of slab and forms. In forming a slab, a metal or other material form pan typically can only span a certain distance without additional support before it may bend or deform under the weight of poured concrete. The slab assembly 240 provides greater spans of the slab 244 and pan 250 by placing permanent or temporary pan supports 260, 264 under the pan 250. As shown a support beam 254 with bars 256 is formed on piers 258 extending into soil 26 (or supported on footers or simply placed on grade) and supports the slab 244 by contacting the bottom of pan 250 at a generally central location and typically, extending across the bottom of the slab 244. The beam 254 is shown to extend substantially perpendicular to the ribs of the slab 244 but may run at any angle transverse to the ribs or even parallel to the ribs. The pan supports 260, 264 are spaced apart from the support beam 254, e.g., generally centrally located between the beam 254 and edges of the slab 244 where sidewalls would support the slab 244 and pan 250. The pan supports 260, 264 and the beam 254 and piers 258 define a void space between the pan 250 and slab 244 and the soil 26 (as described in detail with reference to FIG. 2). The pan supports 260, 264 may be formed of material to allow degradation of the supports 260, 264 (such as corrugated paper and the like as discussed above) or of a more long-lived material (such as many plastics) that may not degrade but preferably, but not necessarily, deforms under pressure created by expansion of the soil 26. In some cases, the pan supports 260, 264 are removed after the setting or hardening of the slab 244 to provide a larger void space and/or to enable reuse of the supports 260, 264.

Referring now to FIG. 8, a removable wall form support assembly 300 is shown that allows void spaces to be more easily and repeatably created under foundation walls and grade beam(s) , such as wall 30 and beam 20 of FIG. 1. Without the use of the assembly 300, void boxes and the like are used with wall panels or forms used to create side walls of a foundation, with the wall panel being pressed up against the sides of the void boxes. The void boxes are left to rot under the wall, which can create mold problems and other degradation problems. The void space also reduces the height of the sidewall achieved by a panel as the panel is positioned against the side of the void. For example, if the wall form or panel is 9 feet in height and the void box is 8 inches in height, the formed wall will have a height of 8 feet 4 inches rather than 9 feet. Often, it is desirable to provide a void under the formed wall while forming a wall with a height defined by the wall panel or form.

The removable form support assembly 300 achieves this by concurrently supporting the wall forms or panels and defining a void space below the supported wall panels. Referring to FIG. 8, during use, the assembly 300 is placed directly on the soil or excavation floor 26 with one end abutting a pier 22. The abutting end (not shown) may conform to the pier 22 by having a recessed half circle and another one of the assemblies 300 may abut the pier 22. In practice, additional assemblies 300 are typically provided as necessary to support each wall panel. In other embodiments (not shown), a hole for encircling a pier 22 may be provided in the surface 320 and wall 330 (and each adjacent assembly 300 would be placed in abutting, end-to-end contact to provide a wall panel support system).

The wall panels 314 are supported by the assembly 300 on form support surfaces or ledges 312, 342 that extend the length of the assembly 300 (although 2 or more intermittent or spaced apart support surfaces could be used for support surfaces 312, 342). These form support surfaces 312, 342 are attached to vertical sidewalls 310 and 340 which also include extensions that extend above the surfaces 312, 342 to provide lateral support or a positioning surface for the panels 314. The distance between the sidewalls 310, 340 defines the width of the formed sidewall after positioning of the panels 314 and pouring of the concrete. Side strengthening members 316, 346 are attached to the side walls 310, 340 and support surfaces 312, 342 to provide increased structural strength for the surfaces 312, 342.

A wall forming surface 320 is attached to the sidewall 310 and extends substantially perpendicularly to the sidewall 310 to provide a form for the bottom edge of the foundation wall. One or more inner vertical supports 322 are provided within the assembly 300 to vertically support the wall forming surface 320 during fabrication of a foundation wall, e.g., to control deformation of the surface 320 under the weight of the non-hardened concrete. A bottom wall 330 may be provided and attached to the sidewall 310 and the inner vertical support 322, with other embodiments not providing a bottom wall 330 to allow for unleveled soil 26 but providing supports for hinge member 344 from support 322, surface 320, and/or wall 310. The length of the inner vertical support or the distance from the wall forming surface 320 to the bottom wall 330 defines height, $Void_3$, of the void space below the formed foundation wall. End walls 326 are provided at each end of the assembly to provide structural integrity and are typically attached to the wall forming surface 320, the bottom wall 330 and the side wall 310 (as noted above, one end wall 326 and the wall forming surface 320 may have a recessed surface in the shape of a half circle for receiving and mating with the top edge of the pier 22).

To allow the assembly to readily be removed after a wall section is formed, one side wall 310 is stationary or fixed to the forming surface 320, the end walls 326, and the bottom wall 330 while the other side wall 340 is pivotable to allow the wall 340 to slide under a formed foundation wall, i.e., to slide through the void space created under the formed wall. To this end, the assembly 300 includes a sidewall hinge 344 attached to the bottom wall 330 and to the pivotable sidewall 340 (at either the outer surfaces or the inner surfaces as shown). A guide tube 318 is provided in the assembly to guide a fastener, such as a threaded bolt, through the, side wall 310 and inner vertical support 322 to mate with a fastener receptacle 348, such as a tube with an inner threading, attached to the side support member 346 and/or the pivotable side wall 340.

During use, the assembly 300 is positioned on the soil 26, the pivotable wall 340 is swung to contact the wall forming surface 320, the fastener 324 is inserted and mated with receptacle 348, and then the panels 314 are positioned on the wall form support ledges 312, 342. While surface 320 is shown generally parallel to bottom wall 330 and perpendicular to side wall 310, the top wall or bottom forming surface 320 may in some embodiments attached to side wall 310 at an angle to slope slightly downward to pivotable wall 340. This slight sloping of surface 320 is useful for increasing the ease of removing the assembly 300 after the wall has set. Typically, but not necessarily, the panel support 342 will still be perpendicular to the wall 340 and at a similar height from bottom wall 330 as panel support 312. The slope is relatively gradual or small and in one embodiment the $VOID_3$ changes from 6 inches to 5.875 inches (e.g., an ⅛-inch drop from one end of surface 320 to the other) at the pivotable wall 340 side of the poured wall.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

I claim:

1. A structural foundation assembly for use in expansive soil, comprising:

a slab form for receiving hardenable material, wherein the slab form is impervious to the hardenable material and is substantially rigid;

a structural slab of the hardenable material cast into the slab form;

structural members extending a distance into the expansive soil and extending upward and having an upper support surface, the distance being selected such that the structural members are substantially immobile relative to the expansive soil; and an elongate support member positioned between and in abutting contact with a bottom surface of the slab form and the upper support surfaces of the structural members to support the slab form and structural slab a void distance above the expansive soil.

2. The structural foundation assembly of claim 1, wherein the support member is a beam formed of concrete.

3. The structural foundation assembly of claim 1, wherein the structural members are concrete piers or helical screws and wherein the structural members and the support member define the void distance.

4. The structural foundation assembly of claim 1, wherein the structural members are concrete footing pads and wherein the footing pads and the support member define the void distance.

5. The structural foundation assembly of claim 1, wherein the slab form has a cross-sectional shape with a series of channels, whereby a plurality of structural ribs are formed on a lower surface of the structural slab.

6. The structural foundation assembly of claim 1, further including a form support spaced apart from the support beam and positioned in abutting contact between the expansive soil and the slab form, wherein the form support is adapted to provide at least temporary structural support for the slab form and the structural slab.

7. The structural foundation assembly of claim 6, wherein the form support comprises a material that physically degrades over time when exposed to moisture.

8. The structural foundation assembly of claim 1, further including a sidewall supporting an edge of the structural slab.

9. The structural foundation assembly of claim 8, wherein the sidewall is formed integrally with the structural slab by pouring the hardenable material in a single pouring.

10. A structural foundation assembly for use in expansive soil, comprising:

a non-perforated slab form for receiving hardenable material;

a structural slab of the hardenable material cast into the slab farm;

structural piers extending a distance into the expansive soil and having an upper support surface; and an elongate support member positioned between and in abutting contact with a bottom surface of the slab form and the upper support surfaces of the structural members to support the slab form and structural slab, wherein the support member comprises a concrete beam having a side contacting the structural piers that is larger than the upper support surface.

11. The assembly of claim 10, wherein the piers comprise concrete and are formed in situ and wherein the support member is formed upon the support surface of the piers.

12. The assembly of claim 10, wherein the piers extend from the expansive soil, whereby the upper surface and the supported support member are positioned a void distance from the expansive soil.

13. The assembly of claim 10, further comprising a sidewall with a support member contacting and vertically supporting the slab form.

* * * * *